United States Patent [19]

Woodard

[11] 4,191,873

[45] Mar. 4, 1980

[54] ILLUMINATED SEALED ROCKER SWITCH

[75] Inventor: Tony O. Woodard, Pine Level, N.C.

[73] Assignee: Eaton Corporation, Cleveland, Ohio

[21] Appl. No.: 15,350

[22] Filed: Feb. 26, 1979

[51] Int. Cl.[2] ..... H01H 9/04; H01H 9/16

[52] U.S. Cl. ..... 200/302; 200/315

[58] Field of Search ..... 200/310, 313, 314, 315, 200/302, 333; 116/279, DIG. 28

[56] References Cited

U.S. PATENT DOCUMENTS

| | | | |
|---|---|---|---|
| 2,512,975 | 6/1950 | Sherrard | 200/315 |
| 2,737,557 | 3/1956 | Johnson | 200/315 X |
| 3,409,751 | 11/1968 | Krieger | 200/315 |
| 3,609,268 | 9/1971 | Sanchez | 200/315 |
| 3,651,296 | 3/1972 | Yarbrough | 200/315 |
| 4,013,857 | 3/1977 | Tanaka | 200/315 |
| 4,101,749 | 7/1978 | Josemans et al. | 200/315 X |
| 4,135,073 | 1/1979 | Kobayashi | 200/315 |

FOREIGN PATENT DOCUMENTS

| | | | |
|---|---|---|---|
| 1336723 | 11/1973 | United Kingdom | 200/315 |

*Primary Examiner*—Stephen Marcus

*Attorney, Agent, or Firm*—Hugh R. Rather; William A. Autio

[57] ABSTRACT

A sealed rocker switch wherein a light transmitting lens is provided in a sealing member to focus and align with a switch position indicating lamp mounted in the switch base and a translucent window in the front of the switch operating rocker.

3 Claims, 3 Drawing Figures

ILLUMINATED SEALED ROCKER SWITCH

BACKGROUND OF THE INVENTION

Rocker switches which provide one or more illuminated operating positions are well known. However, the application of illuminated indicating means to this type of switch has been limited to versions which are unsealed to the entrance of dust, moisture, etc. Certain applications require a sealed type of switch, such as in a marine environment, where operating condition illumination would be desirable.

SUMMARY OF THE INVENTION

It is the primary object of the present inventor to provide a rocker button type of electric switch which is both sealed to entrance of moisture and provides illuminated indication of one or more of its operating positions.

Other objects and advantages of the invention will hereinafter appear in the drawing.

BRIEF DESCRIPTION OF THE DRAWINCS

THE PREFERRED EMBODIMENT

Figure 1:
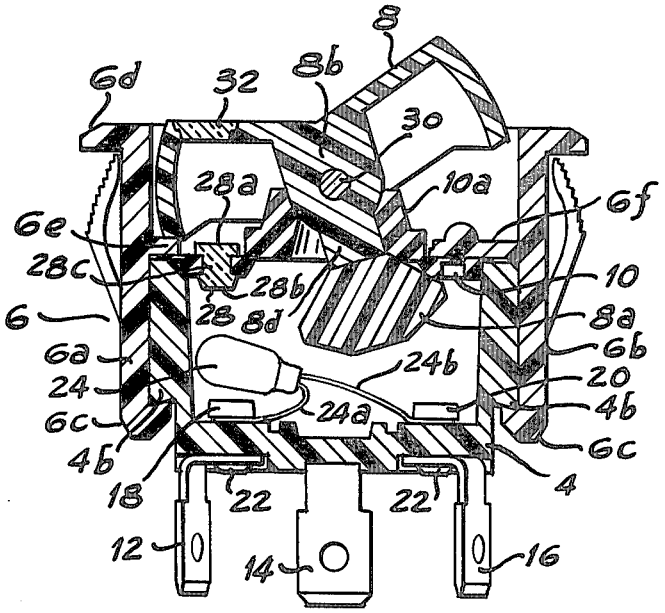
FIG. 1 is a view in longitudinal cross section taken along the line 1—1 of FIG. 2 of a rocker actuator switch constructed in accordance with the invention.
Figure 2:
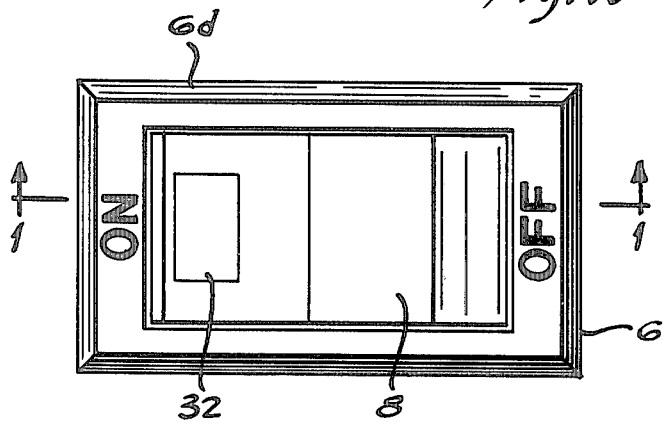
FIG. 2 is a top view of the switch of FIG. 1.

Referring to the drawing the switch of this invention comprises an insulating base 4, a frame 6, a rocker actuator 8, a sealing member 10, and exterior terminals 12, 14 and 16. The base 4, frame 6 and actuator 8 are all preferably formed of a molded insulating material.

The base 4 is generally rectangular in form and provided with a cavity in which seat stationary contacts 18 and 20 that are connected by rivets 22 which extend through openings (not shown) in the base to the terminals 12 and 16. A lamp 24 is electrically connected between contacts 18 and 20 by the leads 24*a* and 24*b* which are trapped between the heads of contacts 18 and 20 and the inner surface of the base 4.

The rocker 8 has an actuator block 8*a* secured to its central stem 8*d* which may be assumed to carry a movable contact operating mechanism not shown. The details of the movable contact and its direct operating mechanism is not shown in the present application for the sake of clarity.

The frame 6 has side walls which overlie the side walls of the base 4, and has depending end tangs 6*a* and 6*b* that have hooked shaped ends 6*c* which engage within complementally formed ledges 4*b* found in the outer end walls of the base 4. The tangs 6*a* and 6*b* are somewhat flexible and ride over the end walls of base 4 and snap-in place at their ends 6*c* into the ledges 4*b* to hold the frame and base in assembled relation.

Figure 3:
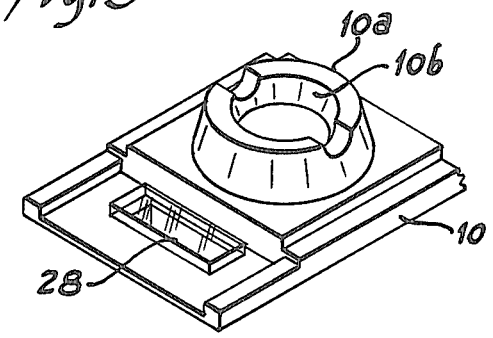
FIG. 3 is a perspective view of a sub-assembly used in the switch.

Frame 6 is provided at its upper surface with a beveled horizontally extending flange portion 6*d*, and inwardly extending ledge portion 6*e* and 6*f* which overlie the upper ends of the base 4. The sealing member 10 of the form best shown in FIG. 3 is seated between the upper ends of base 4 and the ledge 6*e* and 6*f* of the frame as best shown in FIG. 1.

Sealing member 10 is preferably formed of a resilient silicone rubber material. A generally rectangular translucent lens 28 is mounted in a complementally formed opening in member 10. As best shown in FIG. 1 the lens 28 has upper and lower portion 28*a* and 28*b* respectively that overlie the upper and lower surfaces of member 10 and an intermediate undercut portion 28*c* which is sealed within the aforementioned opening in member 10 which preferably has slightly smaller dimensions than the portion 28*c*. In one preferred form lens 28 is formed of a material sold under the trademark of "Lexan".

Sealing member 10 is provided with a central frusto conical boss portion 10*a* that has a generally concaved dished surface 10*b* that sealingly engages with the complementally formed surface on the stem 8*b* of rocker 8. The rocker 8 is journaled on a pivot pin 30 that may be assumed to penetrate aligned openings (not shown) in the upper side walls of the frame 6.

A translucent window 32 is secured in a suitably formed opening of rocker 8 to overlie the lens 28. In the position of the rocker depicted in FIG. 1 the lens 28 and window 30 will all be in alignment with the light emitting bulb of lamp 24 so that an illuminated indication of that switch position will be provided. If the right hand portion of the rocker 8 is depressed, the latter will be moved to its opposite operating position wherein such alignment of the window 30 with the lens 28 and lamp 24 will be interrupted to indicate, for example an "off" position of the switch.

It will be apparent that the preferred embodiment shown is susceptible of modification. For example, the lens 28 and window 30 can have other shapes than rectangular. Also if a three position switch is used with a center "off" position, an additional lamp and set of lens and rocker window could be used at the right hand side of the switch to provide an illuminated indication when the switch is in its other operating position.

I claim:

1. In an electric switch having a base housing the switching mechanism, a rocker actuator pivotally movable to effect operation of the switching mechanism, a frame mounted on the open-end of the base and affording pivotal support for the rocker, and a lamp mounted in said base illuminable to provide indication of a switch operating position, the improvement comprising, an elastic sealing member secured between said frame and the open end of said base and sealing about a portion of said rocker to resist the entrance of moisture, dust and the like into said base, a light transmitting lens mounted in sealing member in alignment with said lamp, and a window mounted in said rocker to align which said lens and said lamp in a given position of said rocker to provide light transmission exteriorally of said switch.

2. The improved electric switch in accordance with claim 1 wherein said lens is made of a transparent plastic material.

3. The improved electric switch in accordance with claim 2 wherein said lens has upper and lower flanges, and an intermediate connecting portion which is resiliently gripped by the margins of the receiving opening formed in said sealing member.

* * * * *